US007290977B2

(12) United States Patent
Albright et al.

(10) Patent No.: US 7,290,977 B2
(45) Date of Patent: Nov. 6, 2007

(54) POWERED COUPLING OF ATTACHMENT HYDRAULICS

(75) Inventors: Larry E. Albright, Gwinner, ND (US); Wally L. Kaczmarski, Lisbon, ND (US)

(73) Assignee: Clark Equipment Company, Montvale, NJ (US)

( * ) Notice: Subject to any disclaimer, the term of this patent is extended or adjusted under 35 U.S.C. 154(b) by 28 days.

(21) Appl. No.: 11/075,926

(22) Filed: Mar. 9, 2005

(65) Prior Publication Data

US 2006/0245903 A1 Nov. 2, 2006

(51) Int. Cl.
*E02F 9/00* (2006.01)

(52) U.S. Cl. ..... 414/723; 37/468; 91/432; 403/321

(58) Field of Classification Search ..... 414/723; 37/468; 91/432; 463/321, 322.1, 322.3; 901/29

See application file for complete search history.

(56) References Cited

U.S. PATENT DOCUMENTS

| | | | | |
|---|---|---|---|---|
| 3,039,837 A | | 6/1962 | Poe | 312/320 |
| 3,243,066 A | | 3/1966 | Gardner et al. | 214/140 |
| 3,653,405 A | | 4/1972 | Nelson | 137/594 |
| 3,730,221 A | | 5/1973 | Vik | 137/614 |
| 3,874,411 A | | 4/1975 | Vik | 137/614.06 |
| 4,192,347 A | | 3/1980 | Richard | 137/614.06 |
| 4,208,163 A | | 6/1980 | Holmqvist | 414/723 |
| 4,210,348 A | | 7/1980 | Hobson et al. | 285/1 |
| 4,630,878 A | | 12/1986 | Heine et al. | 339/75 |
| 4,664,588 A | * | 5/1987 | Newell et al. | 414/730 |
| 4,738,463 A | | 4/1988 | Poore et al. | 280/421 |
| 4,955,779 A | | 9/1990 | Knackstedt | 414/723 |
| 5,108,252 A | | 4/1992 | Gilmore et al. | 414/694 |
| 5,199,844 A | | 4/1993 | Gilmore et al. | 414/694 |
| 5,333,400 A | | 8/1994 | Sonerud | 37/468 |
| 5,360,313 A | | 11/1994 | Gilmore, Jr. et al. | 414/694 |
| 5,403,144 A | | 4/1995 | Staben, Jr. | 414/697 |
| 5,452,736 A | | 9/1995 | Arosio | 137/75 |
| 5,465,513 A | | 11/1995 | Sonerud | 37/468 |
| 5,484,250 A | | 1/1996 | Gilmore, Jr. et al. | 414/723 |
| 5,562,397 A | * | 10/1996 | Albright | 414/723 |
| 5,662,141 A | | 9/1997 | Arosio | 137/614.05 |

(Continued)

FOREIGN PATENT DOCUMENTS

FR 2 676 765 A1 5/1991

OTHER PUBLICATIONS

Search Report and Written Opinion dated Jun. 30, 2006 for International Application No. PCT/US2006/006117, filed Feb. 22, 2006.

*Primary Examiner*—Donald Underwood
(74) *Attorney, Agent, or Firm*—Michael Best & Friedrich LLP

(57) ABSTRACT

An actuator operated apparatus for mounting and hydraulically coupling a working attachment to a mounting plate of a work vehicle. The apparatus receives a portion of pressurized fluid from the work vehicle to actuate a pair of wedges that slidably move to lock or unlock the working attachment and the mounting plate. The apparatus receives a remaining portion of the pressurized fluid from the work vehicle to engage or disengage at least one hydraulic coupler of a first coupling block and at least one hydraulic coupler of a second coupling block.

21 Claims, 10 Drawing Sheets

U.S. PATENT DOCUMENTS

| | | | | |
|---|---|---|---|---|
| 5,802,753 | A | 9/1998 | Raunisto | 37/468 |
| 5,967,738 | A | 10/1999 | Warthold | 414/723 |
| 6,196,595 | B1 | 3/2001 | Sonerud | 285/26 |
| 6,390,765 | B1 | 5/2002 | Dick | 414/723 |
| 6,899,509 | B1 * | 5/2005 | Mailleux | 414/723 |
| 2002/0127090 | A1 * | 9/2002 | Dick | 414/723 |

* cited by examiner

POWERED COUPLING OF ATTACHMENT HYDRAULICS

BACKGROUND OF THE INVENTION

The present invention relates to mounting accessories on a work vehicle. In particular, the present invention relates to an actuator for joining hydraulic line couplers.

Hydraulic couplers include a female part into which a male part can be inserted and are known in the prior art. Pressure in one or both of the hydraulic hoses being coupled together when mounting an attachment device causes loads on valves that must be moved and opened or unseated for coupling. The force required to couple the parts can require more force than a human can directly apply until an appropriate amount of pressure is relieved. In the prior art, hydraulic pressure in both lines generally has to be bled or released in some manner to allow manual connection of the male and female coupler parts. Hydraulic pressure buildup is a particular problem when the attachment device being controlled is an implement under a load that creates pressure in a hydraulic line. The manual attachment of the coupler under these circumstances is difficult, due to the circuit pressure.

U.S. Pat. No. 5,562,397, which is herein incorporated by reference in its entirety, shows a quick attachment device having a power actuator that is used for quickly operating latches for attaching and detaching various accessories on the attachment plate at the front of the loader. The quick attachment device has been used extensively by Melroe Company, a business unit of Clark Equipment Company and sold under the mark Bobtatch™.

The present invention is made to utilize the actuator operation of quick attachment systems, similar to the above-identified patented system, to couple hydraulic couplers for the auxiliary implement being attached, even if hydraulic pressure is trapped in one of the lines.

SUMMARY OF THE INVENTION

The present invention includes an actuator operated apparatus for mounting and hydraulically coupling a working attachment to a mounting plate of a work vehicle. The apparatus includes a pair of locking hydraulic actuators configured to receive a portion of pressurized fluid from the work vehicle to actuate a pair of wedges that slidably move to one of lock and unlock the working attachment and the mounting plate. The present invention also includes a first hydraulic coupling block mounted to the working attachment and configured to house at least one hydraulic coupler. The apparatus also includes a second hydraulic coupling block mounted to the mounting plate and configured to house at least one hydraulic coupler. A coupling hydraulic actuator is mounted to the mounting plate. The coupling hydraulic actuator is configured to receive a remaining portion of the pressurized fluid from the work vehicle to slidably actuate the second coupling block for one of engaging and disengaging the at least one hydraulic coupler of the first coupling block with the at least one hydraulic coupler of the second coupling block.

DETAILED DESCRIPTION OF THE PREFERRED EMBODIMENTS

Embodiments of the present invention are directed towards an automatic coupling block actuated by a hydraulic actuator that hydraulically couples and/or non-hydraulically couples a working implement to a work vehicle. Embodiments of the present invention allow an operator or pilot to remain in an operator seat while mounting a variety of types of tools to a work vehicle. The pilot can make hydraulic and electrical connections with ease even when there is hydraulic pressure in the fluid lines. Embodiments of the present invention also provide a standard location for the hydraulic coupling connectors on a mounting plate to thereby allow various working implements to have a standard hose size for all work vehicle sizes. Implementing a standard hose size eliminates changing hose lengths and/or routing hoses to accommodate different work vehicle sizes.

Figure 1:
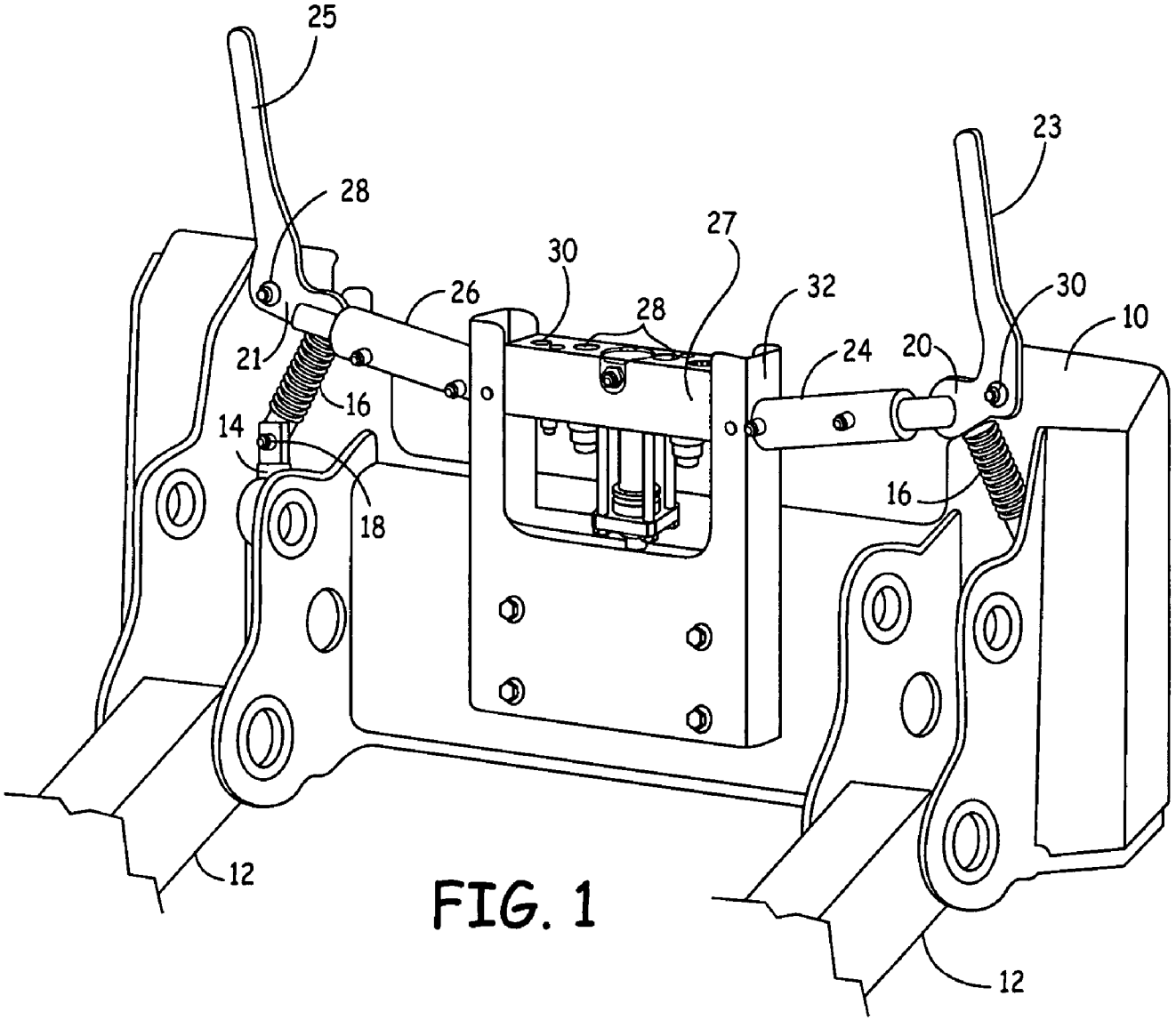
FIG. 1 is a perspective view of a mounting plate for a work vehicle in accordance with an embodiment of the present invention.

FIG. 1 is a perspective view of an attachment plate or a mounting plate 10 for a work vehicle, such as a skid steer loader, in accordance with an embodiment of the present invention. FIG. 1 illustrates mounting plate 10 in an unlocked position.

Figure 2:
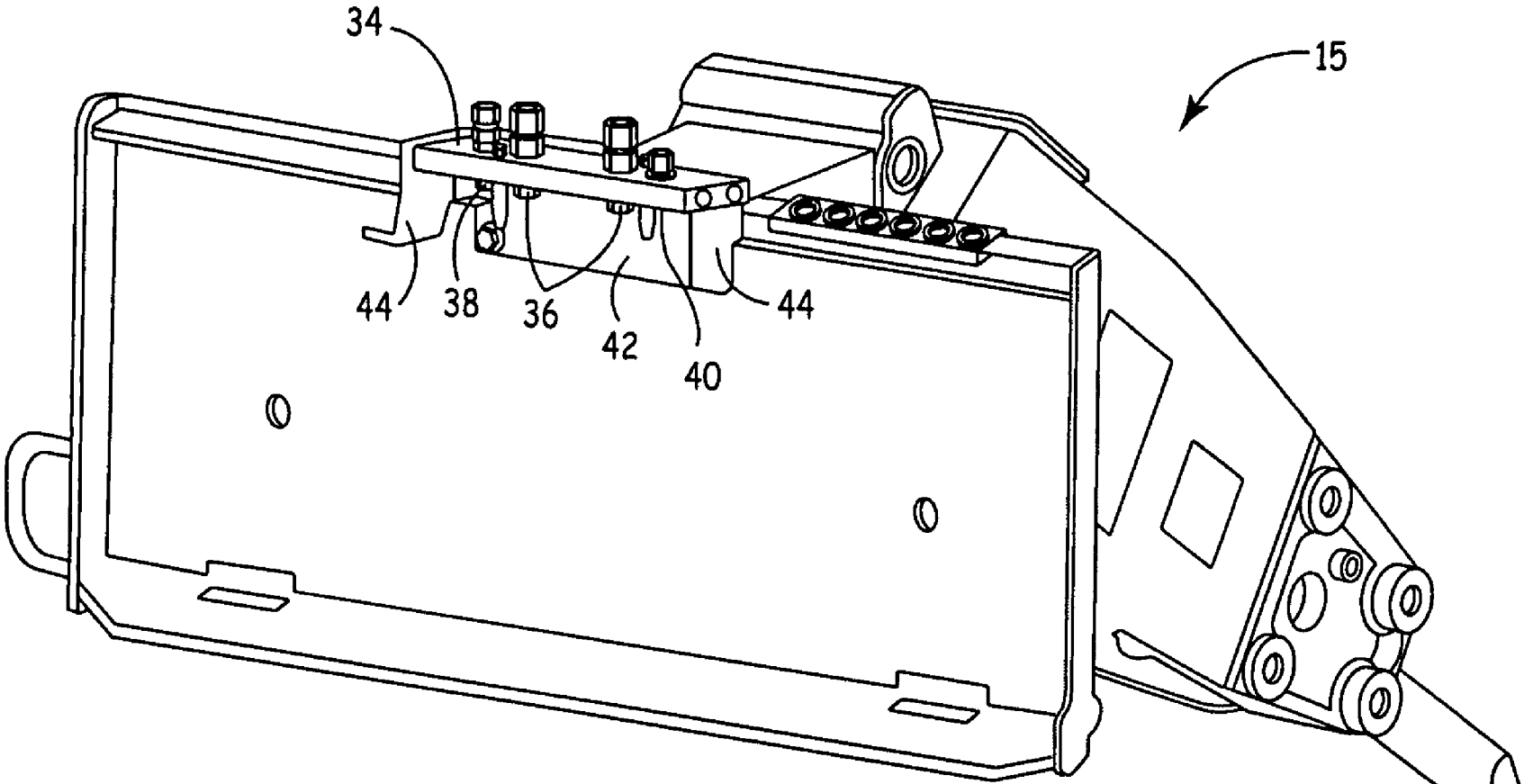
FIG. 2 is a perspective view of a working attachment in accordance with an embodiment of the present invention.
Figure 3:
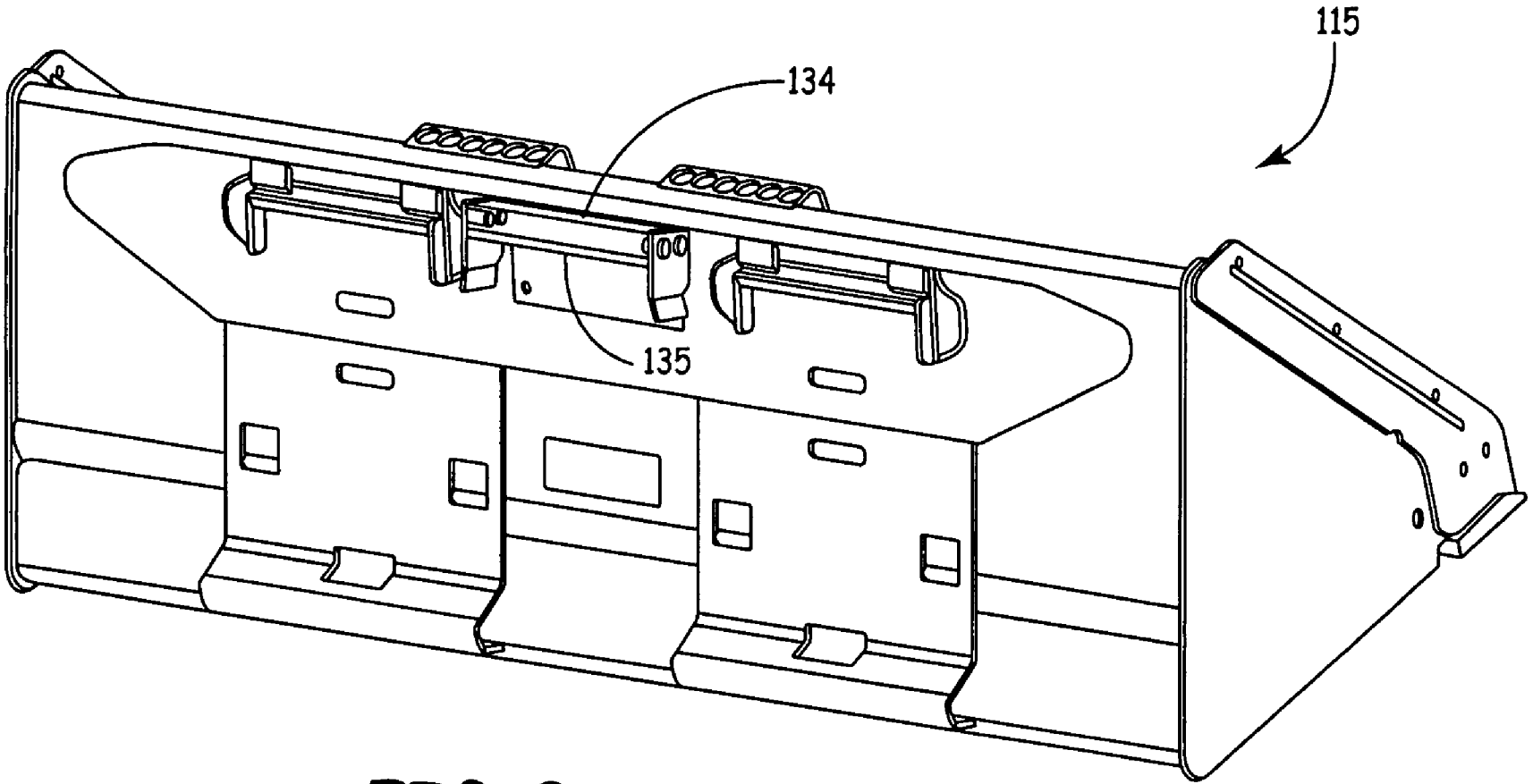
FIG. 3 illustrates a perspective view of a working attachment in accordance with an embodiment of the present invention.

Mounting plate 10 is mounted on loader arms shown fragmentarily at 12, and is used for mounting a working attachment (illustrated in FIGS. 2 and 3). In FIG. 2, working attachment or implement 15 is a hydraulic breaker. However, it should be noted that working attachment 15 can be other types of hydraulically powered working implements. Examples of hydraulic working implements include a power-operated auger or a backhoe. In FIG. 3, working attachment or implement 115 is a non-hydraulic bucket. However, it should be noted that working attachment 115 can be other types of passive working implements, such as an angle broom.

Referring back to FIG. 1, attachment or mounting plate 10 is configured to latch or lock working attachment 15 to a work vehicle with sliding wedges 14. Mounting plate 10 includes left and right side wedges 14 that are slidable in suitable guides for vertical movement between latched and unlatched positions (the right wedge is obstructed from view). Each wedge 14 is moved by a link 16 connected to an upper end of the respective wedge 14 at 18. Each link 16 is connected to a bell crank. One of the links 16 is connected to a right bell crank 20 with a pivot pin (not shown) and the other of the links 16 is connected to a left bell crank 21 with a pivot pin (not shown).

Each wedge is actuated by a locking hydraulic actuator or cylinder. Right-handed locking actuator or cylinder 24 is connected to right bell crank 20 and a left-handed locking actuator or cylinder 26 is connected to left bell crank 21. Left bell crank 21 is mounted onto an upper left edge of mounting plate 10 at pivot 28 and right bell crank 20 is mounted onto an upper right edge of mounting plate 10 at pivot 30. Upon remotely powering hydraulic actuation of locking cylinders 24 and 26, bell cranks 20 and 21 are pivoted and the associated links 16 will move each wedge 14 to a locked or unlocked position. U.S. Pat. No. 5,562,397 shows embodiments of mounting plate 10 and sliding wedges 14. Although the present invention is described with reference to the locking and unlocking of wedges 14 as being hydraulically powered, it should be noted that wedges 14 can also be manually locked or unlocked using levers 23 and 25.

Mounting plate 10 also includes a moveable female hydraulic coupling block 27. Female hydraulic coupling block 27 houses a pair of female hydraulic couplers 28, a female drain coupler 30 and a female electrical connector (not shown in FIG. 1). Although not illustrated in FIG. 1, each female coupler is attached to hydraulic hoses and electrical lines that lead to auxiliary controls on a work vehicle. Female coupling block 27 is mounted to mounting plate 10 with a mounting bracket 32 and is configured to hydraulically couple to a fixed male hydraulic coupling block, such as male coupling block 34 illustrated in FIG. 2. Male coupling block 34 and female coupling block 27 connect together to form a hydraulic coupling housing such that a work vehicle can control and operate an electrical and a hydraulically powered working attachment.

Referring to FIG. 2, male coupling block 34 houses a pair of male hydraulic couplers 36, a male drain coupler 38 and a male electrical connector 40. Although not illustrated in FIG. 2, each male coupler is attached to hydraulic fluid hoses and electrical lines that lead to hydraulic and electrical components of working attachment 15. Male coupling block 34 is mounted to working attachment 15 with a mounting bracket 42 and is configured to hydraulically couple to a female coupling block, such as female coupling block 27 of FIG. 1, to form a hydraulic coupling housing. Mounting bracket 42 includes block aligning guide tabs 44 in order to align male coupling block 34 with a female coupling block.

In the alternative, FIG. 3 illustrates a passive or non-hydraulic working attachment 115 in accordance with another embodiment of the present invention. In FIG. 3, working attachment 115 includes a fixed dummy block 134. Dummy block 134 takes the place of a male coupling block. A female hydraulic coupling block located on a mounting plate, as illustrated in FIG. 1, is configured to engage with dummy block 134 of FIG. 3. Dummy block 134 acts as a cover to protect the otherwise exposed female hydraulic couplers on the female coupling block. In one embodiment, dummy block 134 can prevent damage to female coupler interfaces, such as 28 and 30 of FIG. 1, from falling debris. In another embodiment, dummy block 134 can include a soft foam gasket 135 such that dust is unable to contaminate hydraulic fluid.

Figure 4:
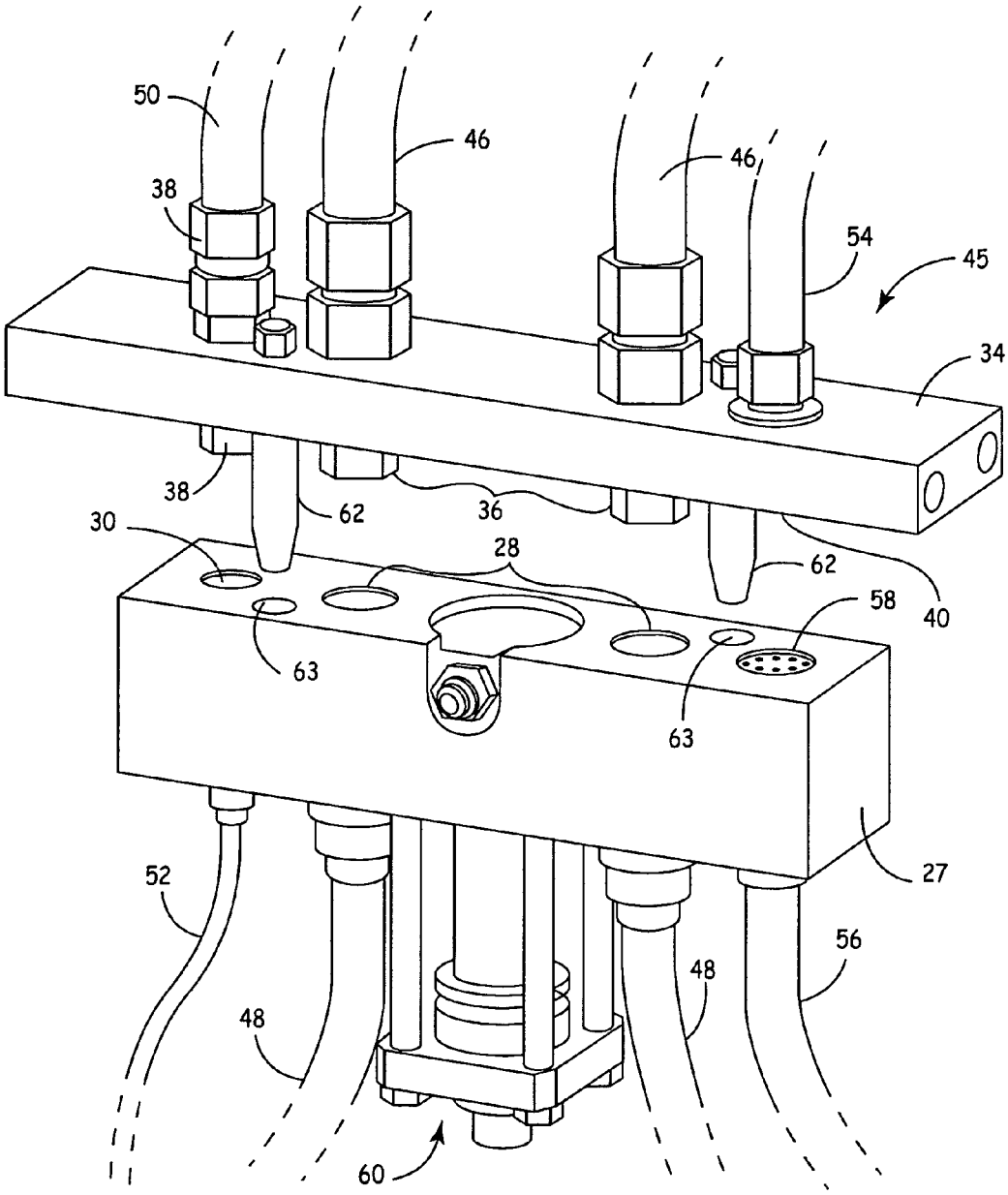
FIG. 4 is an enlarged perspective view of a hydraulic coupling housing in an uncoupled position in accordance with an embodiment of the present invention.

FIG. 4 illustrates an enlarged perspective view of hydraulic coupling housing 45 in an uncoupled position in accordance with an embodiment of the present invention. Hydraulic coupling housing 45 includes female coupling block 27 and a male coupling block 34. A pair of hydraulic hoses 46 are connected to male couplers 36, which lead to hydraulically actuated components on working attachment 15 (FIG. 2) and a pair of hydraulic hoses 48 are connected to female hydraulic couplers 28 which lead to auxiliary controls on the working vehicle. In addition, a drain line 50 is connected to male drain connector 38, which leads to hydraulically actuated components on working attachment 15 and a drain line 52 is connected to female drain connector 30, which leads to the working vehicle. It should be noted that in one alternative embodiment, hydraulic coupling housing 45 includes more than one pair of female and male couplers connected to more than one pair of hydraulic hoses. In another alternative embodiment, hydraulic coupling housing 45 includes a single female and single male coupler connected to a single set of hydraulic hoses.

In addition, hydraulic coupling housing 45 includes an electrical line 54 connected to male electrical connector 40, which leads to electrical components on working attachment 15 and an electrical line 56 connected to female electrical connector 58, which leads to a control circuit on a working vehicle. It should be noted that FIG. 4 illustrates male electrical connector 40 and female electrical connector 58 as being a seven-pin connector. However, those skilled in the art should recognize that male and female electrical connectors 40 and 58 can be any suitable electrical connector.

Figure 5:
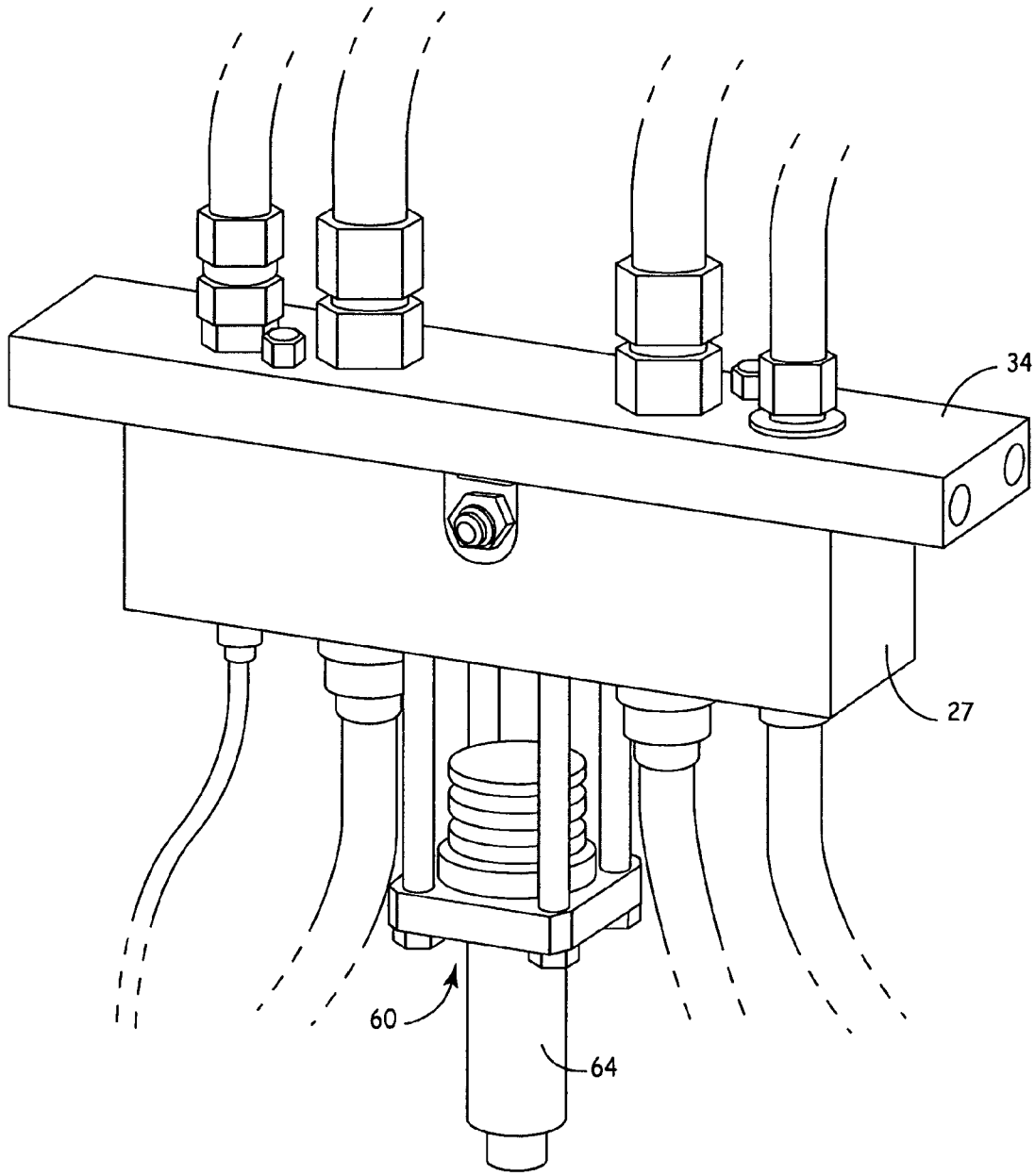
FIG. 5 is an enlarged perspective view of a hydraulic coupling housing in a coupled position in accordance with an embodiment of the present invention.

Female coupling block 27 includes a hydraulic coupling actuator or cylinder 60 such that moveable female coupling block 27 can be remotely controlled to hydraulically couple with fixed male coupling block 34 as illustrated in FIG. 5. Female coupling block 27 is aligned to male coupling block 34 with use of alignment pins 62 carried on the male coupling block that fit into receptacles 63 on the female coupler block. Coupling cylinder 60 includes a piston 64 and a rod (not shown). Piston 64 extends over the rod to engage moveable female coupling block 27 with fixed male coupling block 34.

Figure 6:
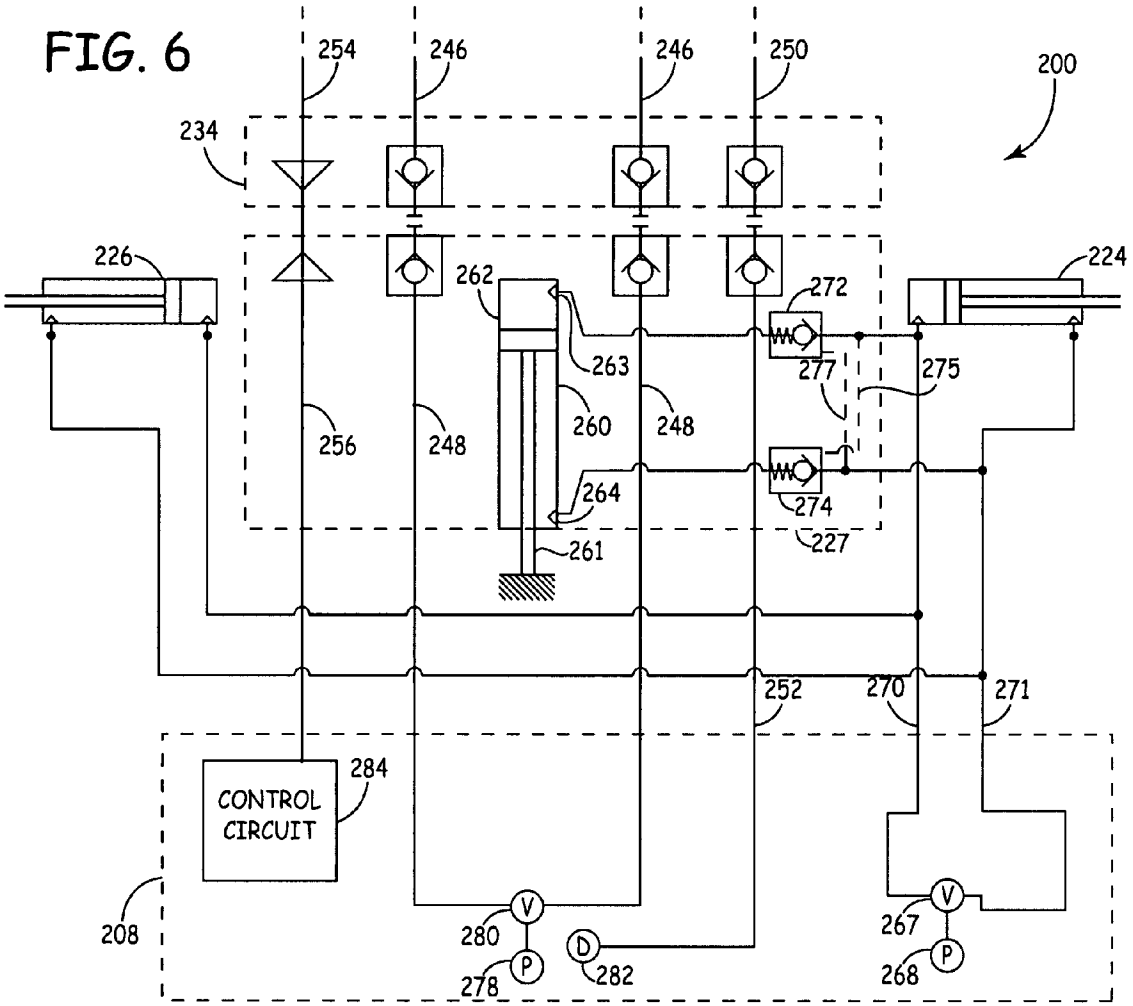
FIG. 6 illustrates a simplified schematic diagram of a hydraulic circuit for engaging a hydraulically operated working attachment with a mounting plate in accordance with an embodiment of the present invention.

FIG. 6 illustrates a simplified schematic diagram of a hydraulic circuit 200 for engaging a hydraulically operated working attachment with a mounting plate coupled to a working vehicle 208 in accordance with an embodiment of the present invention. A male coupling block 234 is mounted to a working attachment, such as working attachment 15 illustrated in FIG. 2. A female coupling block 227 is mounted to a mounting plate, such as mounting plate 10 illustrated in FIG. 1.

FIG. 6 also illustrates a pair of locking cylinders 224 and 226 configured to power attach a mounting plate to a working attachment. Locking cylinders 224 and 226 are remotely controlled by a pilot operated working vehicle 208. To attach a working attachment to a mounting plate, the pilot provides a portion of pressurized hydraulic fluid to locking cylinders 224 and 226 through fluid line 270 using pump 268 and valve 267 located in work vehicle 208. To detach a working attachment from a mounting plate, the pilot provides the portion of pressurized hydraulic fluid to locking cylinders 224 and 226 through fluid line 271 using pump 268 and valve 267.

FIG. 6 also illustrates a hydraulic coupling cylinder 260 configured to engage moveable female coupling block 227 with fixed male coupling block 234 substantially simultaneous with actuation of locking cylinders 224 and 226. Cylinder 260 includes a double acting piston 262 coupled to a rod 261. Cylinder 260 is coupled to a pair of check valves 272 and 274 which are incorporated into female coupling block 227. To actuate cylinder 260 such that female coupling block 227 is engaged with male coupling block 234, a pilot provides a remaining portion of the pressurized fluid from fluid line 270 through check valve 272 to a connection 263 at the upper end of cylinder 260. At approximately the same time, the pressure in fluid line 270, acting through a pilot connection indicated at dashed line 275, will open check valve 274 to permit fluid to flow out of the lower end of cylinder 260. To actuate cylinder 260 such that female coupling block 227 is disengaged with male coupling block 234, a pilot provides the remaining portion of the pressurized fluid from fluid line 271 through check valve 274 to a connection 264 at the lower end of cylinder 260. At approximately the same time, the pressure in fluid line 271, acting through a pilot connection indicated at dashed line 277, will open check valve 272 to permit fluid to flow out of the upper end of cylinder 260.

Figure 8:
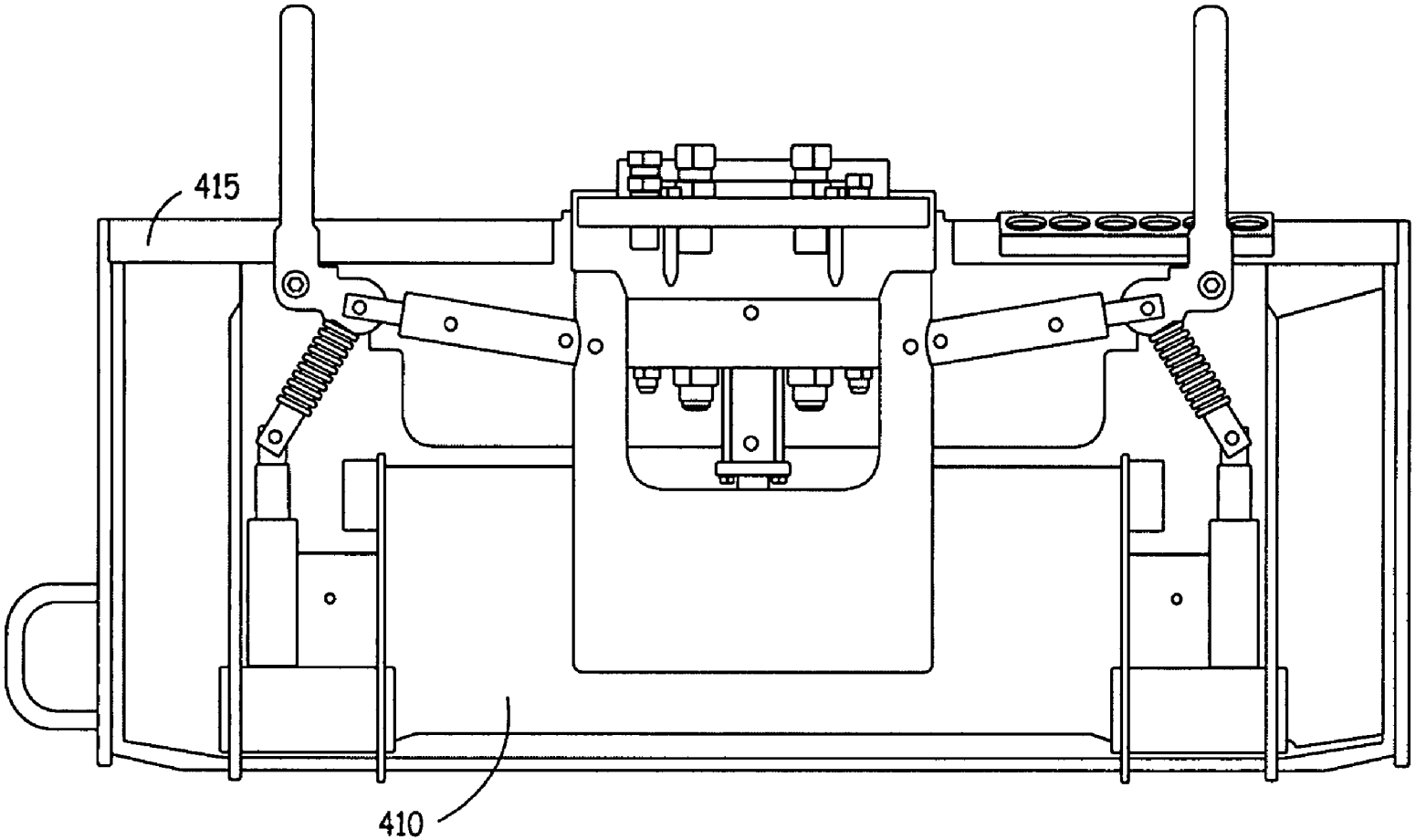
FIG. 8 illustrates a rear elevation view of a mounting plate and a working attachment in an uncoupled position in accordance with the present invention.
Figure 9:
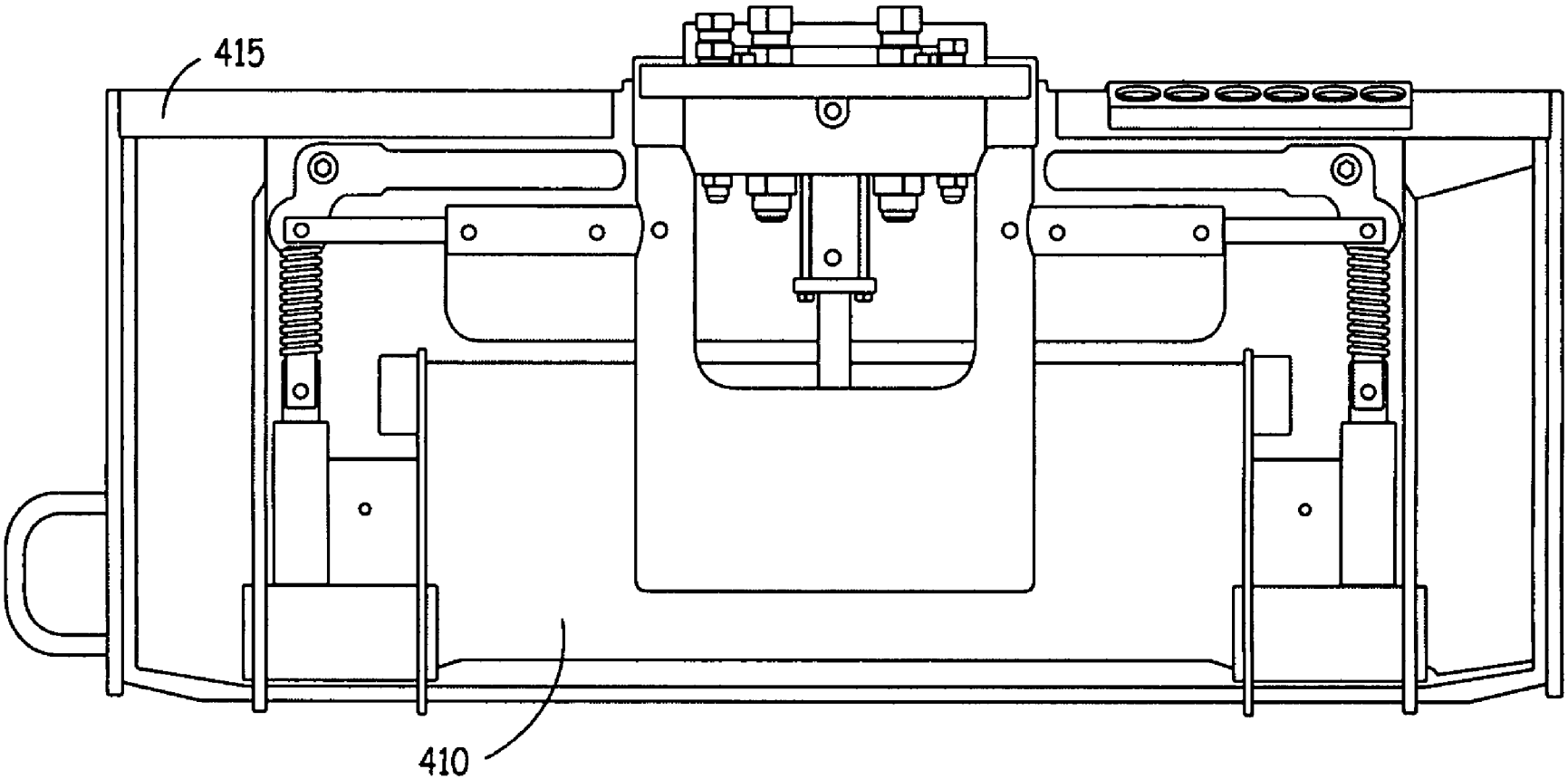
FIG. 9 illustrates a rear elevation view of a mounting plate and a working attachment in a coupled position in accordance with the present invention.
Figure 10:
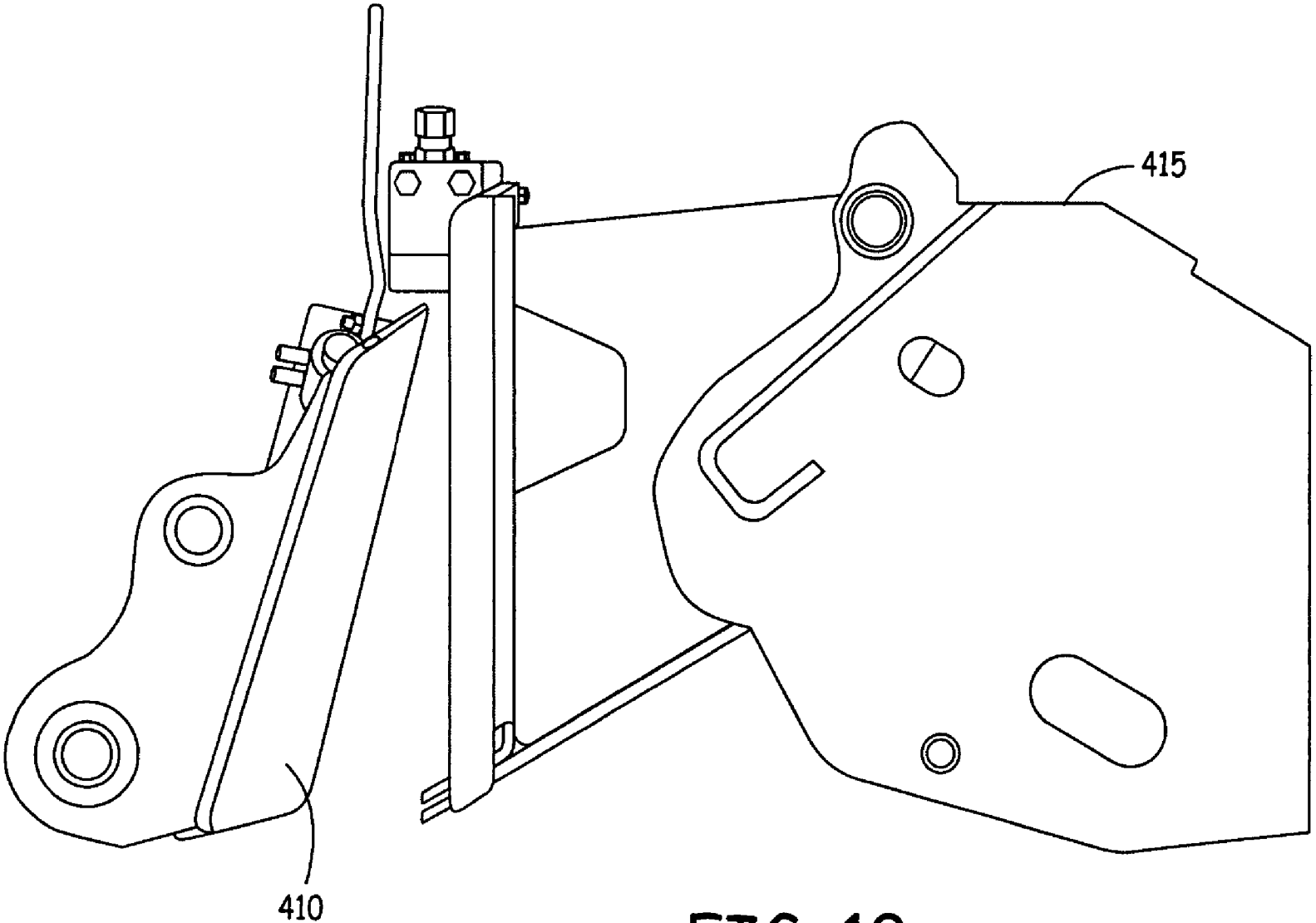
FIG. 10 illustrates a side elevation view of a mounting plate and a working attachment in the process of engaging in accordance with the present invention.

For example, FIGS. 8-10 illustrate a mounting plate 410 and a working implement 415 in accordance with the present invention. FIG. 8 illustrates a rear elevation view of mounting plate 410 and working implement 415 in an unlocked position and a hydraulically uncoupled position. FIG. 10 illustrates a side elevation view of mounting plate 410 and working implement 415 in an unlocked position and a hydraulically uncoupled position. FIG. 9, however, illustrates a rear elevation view of mounting plate 410 engaged with working implement 415 in both a locked position and a hydraulically coupled position.

In the embodiment illustrated in FIG. 6, a pilot can remotely control locking cylinders 224 and 226 to attach a working attachment to a mounting plate substantially simultaneously with controlling coupling cylinder 260 to engage female coupling block 227 with male coupling block 234. In addition, a pilot can remotely control locking cylinders 224 and 226 to detach a working attachment from a mounting plate substantially simultaneously to controlling coupling cylinder 260 to disengage female coupling block 227 from male coupling block 234.

After female coupling block 227 is engaged with male coupling block 234, a fluidic connection is made between the pair of fluid lines 246 and 248 and drain lines 250 and 252. Upon connection, the pair of fluid lines 246 and 248 are coupled to work vehicle 208 for operation of hydraulic components in the working attachment. Work vehicle 208 includes a pump 278 and a valve 280. Similarly, drain line 250 is coupled to drain 282 of work vehicle 208. After female coupling block 227 is engaged with male coupling block 234, an electrical connection is made between electrical lines 254 and 256 such that the working attachment is coupled to a control circuit 284 on work vehicle 208 for electrical operation of the working attachment.

It should be noted that FIG. 6 illustrates an exemplary hydraulic circuit 200. Alternate embodiments and configurations of a hydraulic circuit for the present invention are possible. For example, a hydraulic circuit alternatively can include a communication fluid pressure path between connections 263 and 264 to maintain sufficient extension forces such that blocks 227 and 234 do not separate.

Figure 7:
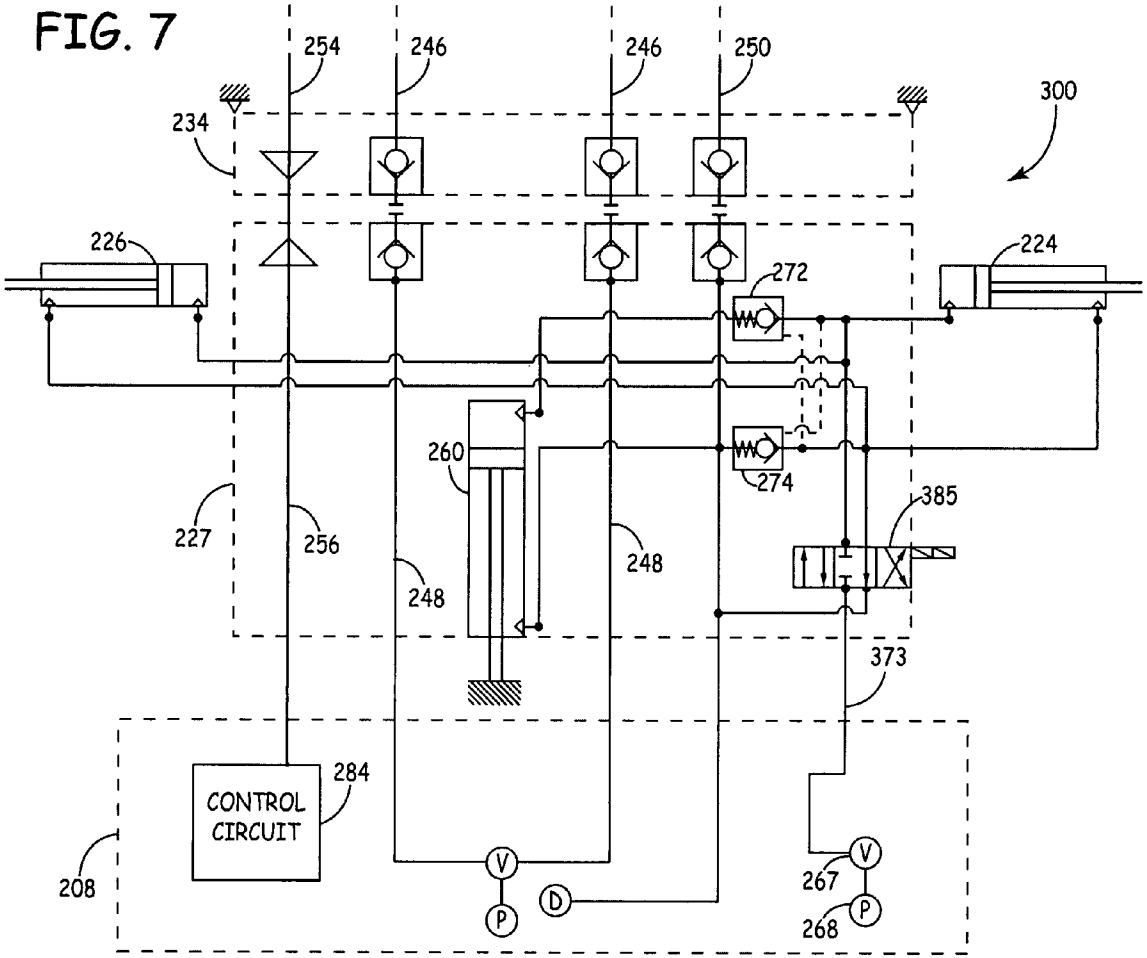
FIG. 7 illustrates a simplified schematic diagram of a hydraulic circuit for engaging a hydraulically operated working attachment with a mounting plate in accordance with an embodiment of the present invention.

FIG. 7 illustrates a simplified schematic diagram of a hydraulic circuit 300 for engaging a hydraulically operated working attachment with a mounting plate coupled to work vehicle 208 in accordance with an alternative embodiment of the present invention. In this embodiment, female coupling block 227 includes a cartridge valve 385 that is operated by a pilot of work vehicle 208 via an electrical signal.

Use of cartridge valve 385 eliminates the need for pressurized hydraulic fluid to be provided to locking cylinders 224, 226 and coupling cylinder 260 through a pair of fluid lines 270 and 271 (FIG. 6). Instead, cartridge valve receives pressurized fluid through a single fluid line 373. Cartridge valve 385 can provide fluid to locking cylinders 224 and 226 that either moves the pair of wedges into a locked position or moves the pair of wedges into an unlocked position. Cartridge valve 385 can also provide fluid to either check valve 272 or check valve 274 depending on whether the coupling cylinder is to engage or disengage female coupling block 227 and male coupling block 234.

As noted above under FIG. 6, FIG. 7 also illustrates an exemplary hydraulic circuit 300. Alternate embodiments and configurations of a hydraulic circuit for the present invention are possible.

Although the present invention has been described with reference to preferred embodiments, workers skilled in the art will recognize that changes may be made in form and detail without departing from the spirit and scope of the invention.

What is claimed is:

1. An actuator operated apparatus for mounting and hydraulically coupling a working attachment to a mounting plate of a work vehicle comprising:

a pair of locking hydraulic actuators configured to receive a portion of pressurized fluid from the work vehicle to actuate a pair of wedges that move to one of lock and unlock the working attachment and the mounting plate;

a first hydraulic coupling block mountable to the working attachment and configured to house at least one hydraulic coupler;

a second hydraulic coupling block having a top surface and a bottom surface mountable to the mounting plate and configured to house at least one hydraulic coupler the at least one hydraulic coupler being adjacent the top surface of the second hydraulic coupling block and extending between the top and bottom surfaces of the second hydraulic coupling block; and a coupling hydraulic actuator configured to receive a remaining portion of the pressurized fluid from the work vehicle to actuate the second coupling block to one of engage and disengage the at least one hydraulic coupler and a bottom surface of the first coupling block with the at least one hydraulic coupler and the top surface of the second coupling block.

2. The apparatus of claim 1, wherein the coupling hydraulic actuator comprises a hydraulic cylinder including:

a rod fixable to the mounting plate; and a double acting piston coupled to the rod.

3. The apparatus of claim 1 and further comprising a first check valve configured to provide the remaining portion of pressurized fluid to an upper end of the hydraulic cylinder to slidably move the second coupling block to engage the first coupling block.

4. The apparatus of claim 3 and further comprising a second check valve configured to provide the remaining portion of pressurized fluid to a lower end of the hydraulic cylinder to disengage the second coupling block from the first coupling block.

5. The apparatus of claim 4 and further comprising a cartridge valve configured to direct the portion of pressurized fluid to lock and unlock the working attachment and the mounting plate and configured to direct the remaining portion of the pressurized fluid through one of the first check valve and the second check valve.

6. The apparatus of claim 1, wherein the first coupling block comprises a dummy block configured to cover the at least one hydraulic coupler of the second coupling block if the working attachment is a passive working attachment.

7. The apparatus of claim 6, wherein the dummy block includes a foam gasket to prevent dust from contaminating hydraulic fluid.

8. The apparatus of claim 1, wherein the first coupling block houses at least one male hydraulic coupler the second coupling block houses at least one female hydraulic coupler.

9. The apparatus of claim 1, wherein the first coupling block is further configured to house a male electrical connector and the second coupling block is further configured to house a female electrical connector.

10. The apparatus of claim 9, wherein the male electrical connector and the female electrical connector comprise a seven pin electrical connector.

11. The apparatus of claim 1, wherein the pair of wedges are locked and the first coupling hydraulic block and the second coupling block are engaged substantially simultaneously.

12. The apparatus of claim 1, wherein the pair of wedges are unlocked and the first coupling block and the second coupling block are disengaged substantially simultaneously.

13. An actuator operated apparatus for mounting and hydraulically coupling a working attachment to a mounting plate of a work vehicle comprising:

a first hydraulic coupling block locatable on the working attachment;

a second hydraulic coupling block having a top surface and a bottom surface, the second hydraulic coupling block being mountable to the mounting plate and configured to house at least one hydraulic coupler, the hydraulic coupler being adjacent the top surface and extending between the top and bottom surfaces; and a coupling hydraulic actuator coupled to the second coupling block and configured to receive a portion of a pressurized fluid from the work vehicle to actuate the second coupling block for one of engaging and disengaging the top surface of the second coupling block with a bottom surface of the first coupling block.

14. The apparatus of claim 13, wherein the first coupling block comprises at least one hydraulic coupler.

15. The apparatus of claim 14, wherein the coupling hydraulic actuator actuates the second coupling block for one of engaging and disengaging the at least one hydraulic coupler of the second coupling block and the at least one hydraulic coupler of the first coupling block.

16. The apparatus of claim 13, wherein the first coupling block and the second coupling block each have at least one electrical connector.

17. The apparatus of claim 13, wherein the first coupling block comprises a dummy block configured to cover the at least one hydraulic coupler of the second coupling block if the working attachment is a passive working attachment.

18. The apparatus of claim 13 and further comprising a pair of locking hydraulic cylinders configured to receive a remaining portion of the pressurized fluid from the work vehicle to actuate a pair of wedges that slidably move to one of lock and unlock the working attachment and the mounting plate, the pair of locking hydraulic cylinders and the coupling hydraulic cylinder are actuated substantially simultaneously.

19. In combination with a quick attachment plate for mounting a working attachment to a work vehicle, wherein the working attachment requires hydraulic power, the attachment plate having a pair of coupling wedges at opposite ends thereof operated by a pair of hydraulic locking cylinders receiving pressurized hydraulic fluid, bell crank members at opposite ends of the attachment plate are coupled to a respective wedge, whereby upon actuation of the coupling wedges the respective wedges can be moved between a locking position and a release position, the improvement comprising:

a hydraulic coupler connecting mechanism for connecting a first hydraulic coupling block having lines for providing hydraulic power to the working attachment with a second hydraulic coupling block having a top surface and a bottom surface and having lines for carrying hydraulic pressure from a pump on the work vehicle, the first coupling block having a first hydraulic coupler section to mate with a second hydraulic coupler section on the second hydraulic coupling block, the second hydraulic coupler section having at least one hydraulic coupler adjacent the top surface and extending between the top and bottom surfaces, the second coupling block being operated by a coupling hydraulic actuator receiving a portion of the pressurized hydraulic fluid and supported by the quick attachment plate to one of engage and disengage the top surface of the second coupling block with a bottom surface of the first coupling block.

20. The apparatus of claim 19, wherein the pair of bell cranks are coupled to a pair of respective levers to alternatively manually operate the pair of coupling wedges.

21. The apparatus of claim 19 and further comprising: a first check valve configured to provide the portion of pressurized fluid to the coupling hydraulic actuator to move the second coupling block to engage the first coupling block; and a second check valve configured to provide the portion of pressurized fluid to the coupling hydraulic actuator to move the second coupling block to disengage from the first coupling block.

* * * * *